US009146045B2

(12) United States Patent
Miglio

(10) Patent No.: US 9,146,045 B2
(45) Date of Patent: Sep. 29, 2015

(54) MODULAR CHILLER SYSTEM COMPRISING INTERCONNECTED FLOODED HEAT EXCHANGERS

(71) Applicant: ClimaCool Corp., Oklahoma City, OK (US)

(72) Inventor: Ross A. Miglio, Oklahoma City, OK (US)

(73) Assignee: ClimaCool Corp, Oklahoma City, OK (US)

( * ) Notice: Subject to any disclaimer, the term of this patent is extended or adjusted under 35 U.S.C. 154(b) by 290 days.

(21) Appl. No.: 13/960,926

(22) Filed: Aug. 7, 2013

(65) Prior Publication Data

US 2015/0040607 A1 Feb. 12, 2015

(51) Int. Cl.
*F25B 1/00* (2006.01)

(52) U.S. Cl.
CPC ..... *F25B 1/00* (2013.01); *F25B 2339/024* (2013.01); *F25B 2339/046* (2013.01); *F25B 2339/047* (2013.01); *F25B 2400/06* (2013.01)

(58) Field of Classification Search
CPC ..... F25B 1/00; F25B 2339/047; F25B 2339/024; F25B 2339/046; F25B 2400/06
See application file for complete search history.

(56) References Cited

U.S. PATENT DOCUMENTS

| | | | | |
|---|---|---|---|---|
| 3,537,274 | A | 11/1970 | Tilney | |
| 3,670,522 | A * | 6/1972 | Bresin | 62/333 |
| 4,127,162 | A | 11/1978 | Braver | |
| 4,169,500 | A | 10/1979 | Braver | |
| 4,462,460 | A | 7/1984 | Braver | |
| 4,829,780 | A | 5/1989 | Hughes et al. | |
| 4,852,362 | A | 8/1989 | Conry | |
| 6,116,048 | A | 9/2000 | Hebert | |
| RE37,040 | E | 2/2001 | Hughes et al. | |
| 6,185,946 | B1 | 2/2001 | Hartman | |
| 6,848,267 | B2 | 2/2005 | Pierson | |
| 7,231,773 | B2 | 6/2007 | Crane et al. | |
| 7,257,965 | B2 | 8/2007 | Meister | |
| 7,703,295 | B2 | 4/2010 | Zangari et al. | |
| 2005/0210901 | A1 | 9/2005 | Nash, Jr. | |
| 2007/0261421 | A1 | 11/2007 | Pierson | |
| 2009/0151388 | A1 | 6/2009 | Platt et al. | |
| 2011/0088426 | A1 | 4/2011 | Lochtefeld | |
| 2011/0252821 | A1 | 10/2011 | Miglio | |
| 2012/0103009 | A1 * | 5/2012 | Ding et al. | 62/526 |
| 2012/0117996 | A1 | 5/2012 | Hinde et al. | |
| 2012/0297811 | A1 | 11/2012 | Miglio | |
| 2013/0091891 | A1 * | 4/2013 | Hinde et al. | 62/470 |

FOREIGN PATENT DOCUMENTS

| | | | |
|---|---|---|---|
| CN | 101975482 | A | 2/2011 |
| WO | WO2005083335 | A1 | 9/2005 |

* cited by examiner

*Primary Examiner* — Emmanuel Duke
(74) *Attorney, Agent, or Firm* — Mary M. Lee

(57) ABSTRACT

A modular chiller unit comprising flooded shell-and-tube liquid heat exchangers that are interconnectable with like units to provide a bank of chillers with one large flooded evaporator and one large flooded condenser. The refrigerant circuits are interconnected so that the compressor in one operating unit circulates refrigerant in parallel through the heat exchangers of other non-operating units in the bank. Connecting flanges on the ends of the evaporator and condenser shells facilitate connection between units and also allow stable stacking of the heat exchangers in a single unit. A bank of these modular chillers may further include end caps for the heat exchangers in the last unit and water connecting heads for the heat exchangers in the first unit. This chiller bank combines the convenience and versatility of modular chiller units with the operating efficiency of large flooded evaporator and condensers.

16 Claims, 7 Drawing Sheets

MODULAR CHILLER SYSTEM COMPRISING INTERCONNECTED FLOODED HEAT EXCHANGERS

FIELD OF THE INVENTION

The present invention relates generally to heating and cooling systems and more specifically to modular chiller systems.

BRIEF DESCRIPTION OF THE DRAWINGS

The accompanying drawings, which are incorporated into and form a part of the specification, illustrate one or more embodiments of the present invention and, together with this description, serve to explain the principles of the invention. The drawings merely illustrate one or more preferred embodiments of the invention and are not to be construed as limiting the scope of the invention.

DETAILED DESCRIPTION OF THE PREFERRED EMBODIMENT(S)

Figure 1:
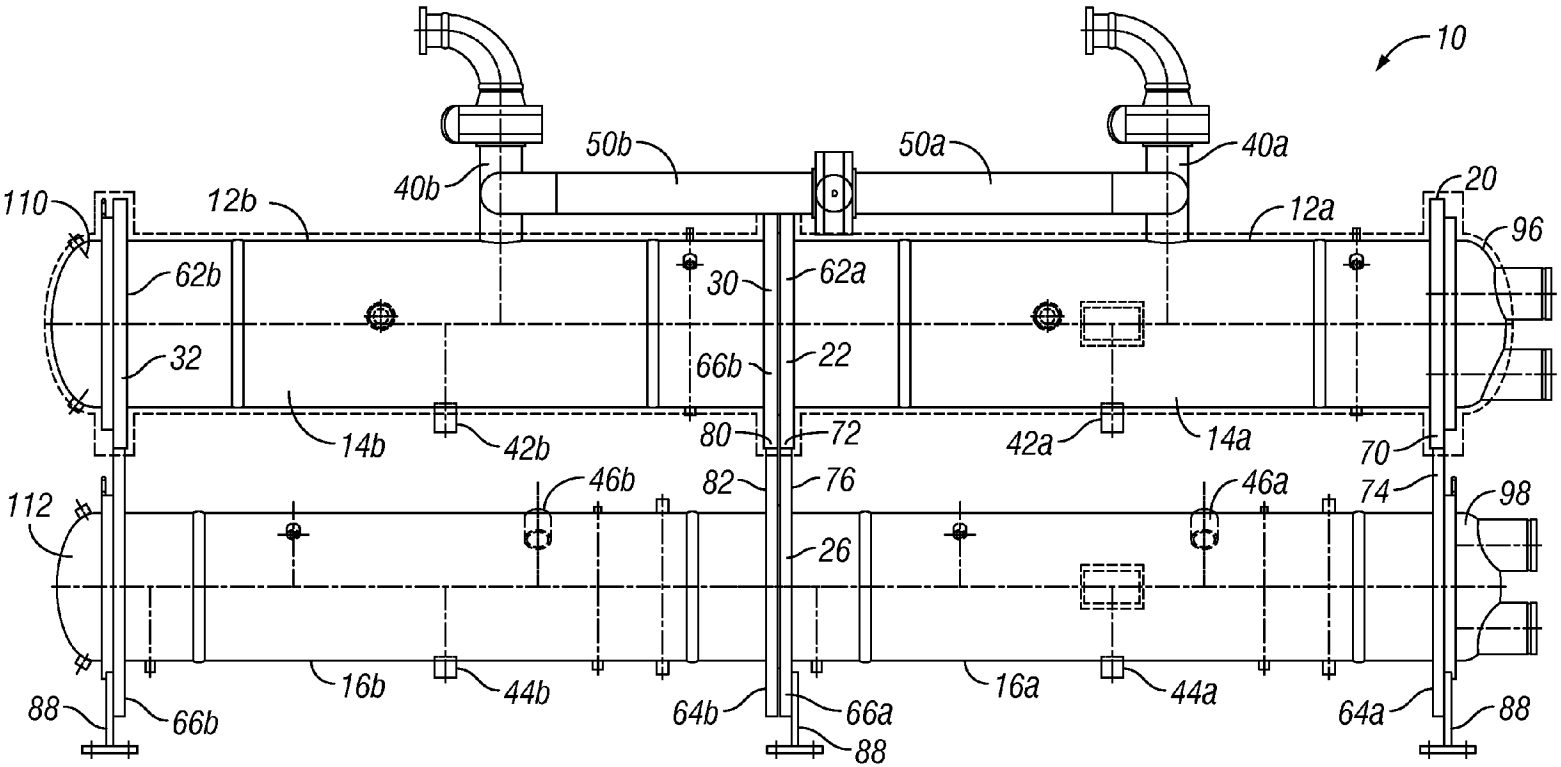
FIG. 1 is a side elevational view of a bank of two interconnected modular chiller units forming a system constructed in accordance with a preferred embodiment of the present invention. The compressors and some of the piping is omitted to simplify the illustration.

Typical commercial chillers spend most of their operating hours at less than full operating capacity. Thus, it is important to maximize energy efficiency in these systems at less than maximum load. For this reason, many conventional non-modular chillers use multiple compressors with a single large flooded evaporator and condenser. The large flooded heat exchangers provide a large heat transfer surface during partial load operation which improves part load energy efficiencies.

By way of example, a 450-ton conventional chiller with three (3) 150-ton compressors may utilize a single 450-ton evaporator and a single 450-ton condenser. During part load operation, one or two of compressors may be staged off or unloaded (or modulated) leaving 150 tons of compressor capacity with the full 450 tons worth of heat transfer surface. This provides high efficiency during part load operation.

Modular chillers are designed for providing incremental changes in capacity, with each modular unit having its own self-contained heat exchangers and compressor. The modular design offers advantages such as compact size, easy rigging and installation, redundancy, and smaller operating footprint. However, because of their design, these units do not allow use of the maximum heat transfer surface when less than all the units are operating.

The present invention provides a modular chiller system in which the heat exchangers and refrigerant circuits are coupled together to create one large heat transfer surface. This provides the advantages of a modular system as well as high efficiency during partial load operation.

Turning now to the drawings in general and to FIGS. 1-4 in particular, shown therein is a modular chiller system constructed in accordance with a preferred embodiment of the present invention and designated generally by the reference number 10. The system 10 comprises a bank of a two of interconnected modules 12*a* and 12*b*. Of course, the number of units may vary. In this system, the evaporator heat exchangers 14*a* and 14*b* are positioned on top of the condenser heat exchangers 16*a* and 16*b*.

In this embodiment, the evaporators 14*a* and 14*b* and the condensers 16*a* and 16*b* are flooded shell-and-tube liquid heat exchangers. The evaporator 14*a* has first and second ends 20 and 22, and the condenser 16*a* has first and second ends 24 and 26. Similarly, the evaporator 14*b* has first and second ends 30 and 32, and the condenser 16*b* has first and second ends 34 and 36.

Each of the ends 20 and 22 and 30 and 32 of the evaporators 14 and 14*b* is connectable to the evaporator of an adjacent like modular chiller unit. In this way, when the unit 12*a* or 12*b* is connected in a bank of like modular chiller units, system 10, the interconnected evaporators 14*a* and 14*b* function as one continuous evaporator. Each of the ends 24 and 26 and 34 and 36 of the condensers 16*a* and 16*b* is connectable to the condenser of an adjacent like modular chiller unit. In this way, when the unit 12*a* or 12*b* is connected in a bank of like modular chiller units, system 10, the interconnected condensers 16*a* and 16*b* function as one continuous condenser.

Each of the units 12*a* and 12*b* also includes a refrigerant circuit comprising a compressor and an expansion valve with connecting conduits, as will be explained in more detail hereafter. The compressor (not shown in FIGS. 1-3) may be positioned on top of the units 12*a* and 12*b* above the evaporators 14*a* and 14*b*. A refrigerant outlet on the top of the evaporators 14*a* and 14*b* is provided for connection to the compressors. Each of the evaporators 14*a* and 14*b* also includes a refrigerant inlet 42*a* and 42*b* for connection to the liquid line (not shown in FIGS. 1-3).

The condenser 16*a* includes a refrigerant inlet 44*a* and a refrigerant outlet 46*a*, and the condenser 16*b* includes a refrigerant inlet 44*b* and a refrigerant outlet 46*b*. These fittings connect to the liquid line of the refrigerant circuit explained below.

Figure 2:
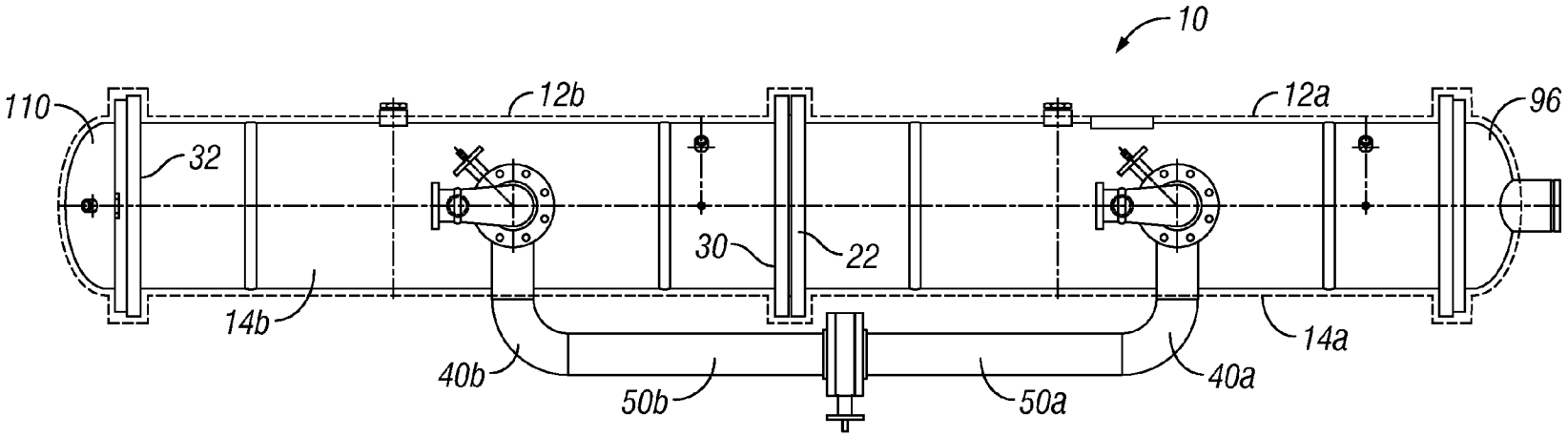
FIG. 2 is a plan view of the modular chiller system shown in FIG. 1.

As shown in FIGS. 1 and 2, each of the units 12*a* and 12*b* includes a suction equalization line 50*a* and 50*b*. Each of the suction equalization lines 50*a* and 50*b* extending between the refrigerant outlets 40*a* and 40*b* so that suction line of the refrigerant circuit of the one unit is connected to the suction line of the refrigerant circuit in the adjacent unit for a reason that will become apparent. In systems that include more than two units, the units interposed between the first and last units in the system will have an equalization line connects to the suction line of the unit on each side.

Referring still to FIGS. 1-4, each of the ends 20, 22, 24, 26, and 30, 32, 24, and 36 is provided with a connecting flange 60*a*, 62*a*, 64*a*, and 66*a*, and 60*b*, 62*b*, 64*b*, and 66*b*. The flanges 60*a*, 62*a*, 64*a*, and 66*a*, and 60*b*, 62*b*, 64*b*, and 66*b* provide a convenient means for bolting adjacent heat exchangers in a fluid tight connection. In a most preferred embodiment, each of the flanges 60*a*, 62*a*, 64*a*, and 66*a*, and 60*b*, 62*b*, 64*b*, and 66*b* has an abutment edge 70, 72, 72, and 76, and 80, 82, 84 and 86, that is, an edge positioned to facilitate stable stacking of one heat exchanger on top of the other. In the embodiment shown, the flanges 60, 62, 64, and 66 are square, which provides a straight edge that abuts a similar straight edge on the heat exchanger above or below. The units 12*a* and 12*b* may also include one or more feet 88 on the bottom of the unit, such as on the flanges 64*a*, 64*b*, 66*a*, and 66*b*, to support the bank of chillers 10 on the floor or other surface.

Figure 4:
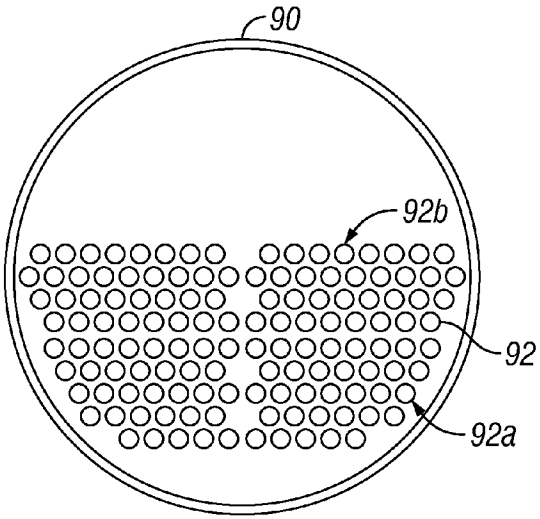
FIG. 4 is an end elevational view of the shell and tube heat exchanger utilized in the preferred embodiment without an end fitting illustrating the heat exchange tubes inside the shell.
Figure 3:
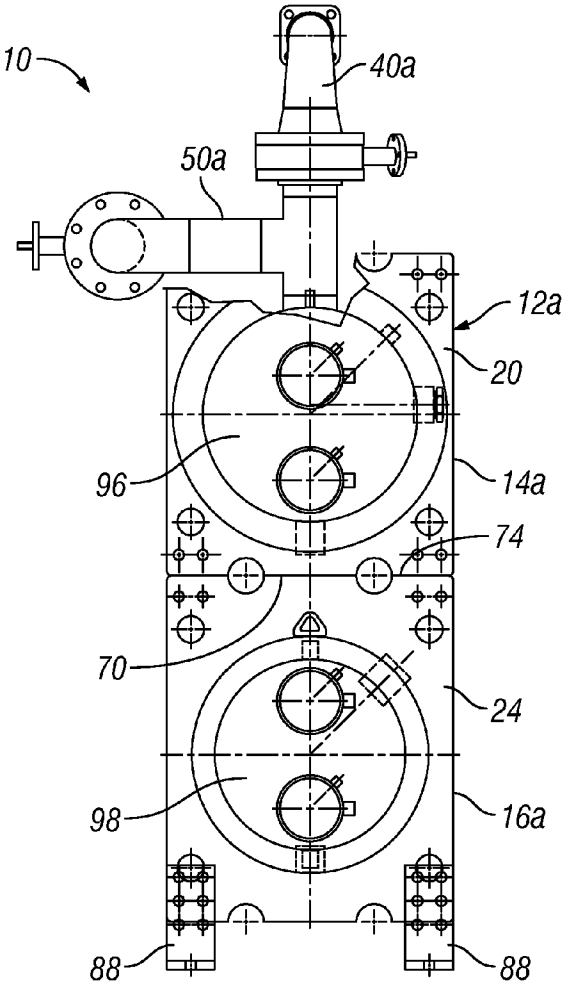
FIG. 3 is a front end view of the modular chiller system shown in FIG. 1.
Figure 6:
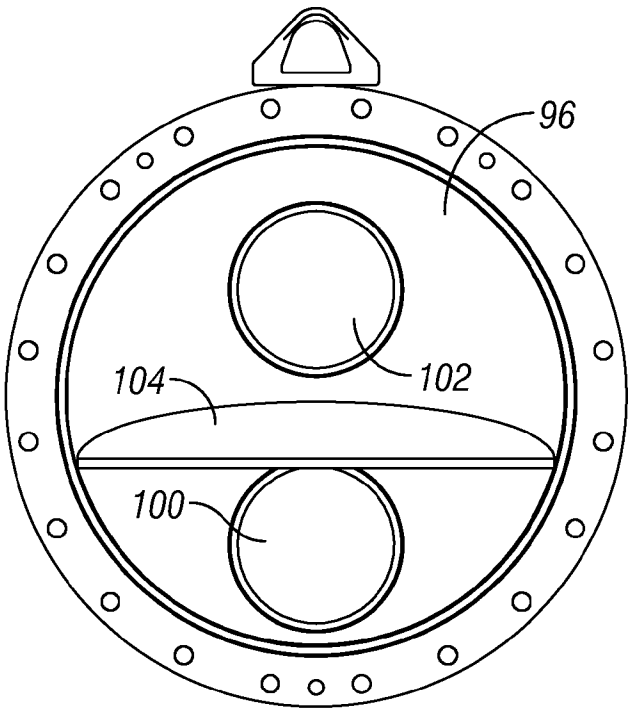
FIG. 6 is an inside or rear elevational view of the water connecting head shown in FIG. 5.
Figure 5:
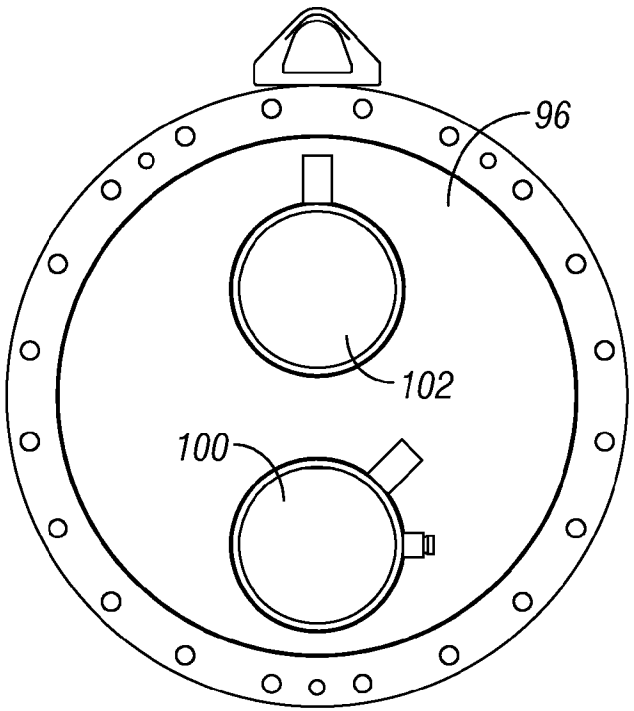
FIG. 5 is a front elevational view of a water connecting head on the front end of the heat exchangers of the modular chiller system shown in FIG. 1.
Figure 8:
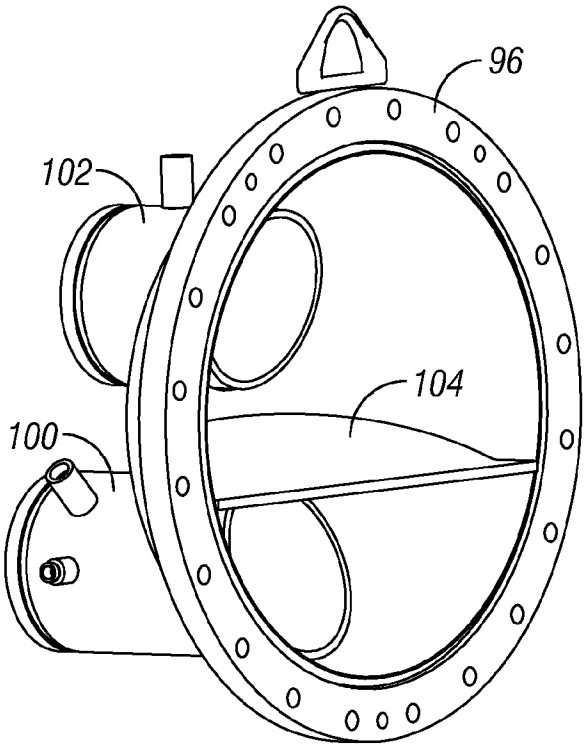
FIG. 8 is a rear perspective view of the water connecting head shown in FIG. 5.
Figure 7:
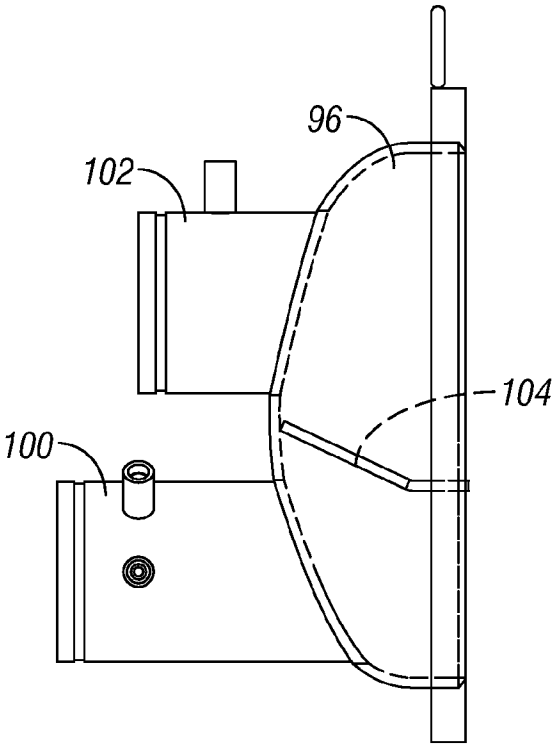
FIG. 7 is a side elevational view of the water connecting head shown in FIG. 5.

FIG. 4 shows an open end of the evaporator 14*a*. The evaporator 14*a* generally comprises a shell 90 and heat exchange tubes 92 mounted inside the shell in a known manner. An end plate 94 on each end of the shell contains the refrigerant in the interior of the shell surround the tubes 92. As seen in FIGS. 1 and 2, each of the ends 20 and 24 of the first or front unit 12*a* is provided with a water (or liquid) connecting head 96 and 98.

The preferred form for the water connecting heads 96 and 98 will be explained with reference to FIGS. 5-8, which depict several views of the head 96. The connecting head 96 may be domed shaped and includes an upper water outlet inlet 100 and a lower water outlet fitting 102. On the inside of the head 96, seen in FIGS. 6-8, a baffle or dividing plate 104 seals against the end plate 94 in the shell 90 thereby dividing the tubes 92 into a plurality of inlet tubes 92*a* and a plurality of outlet tubes 92*b*.

Figure 9:
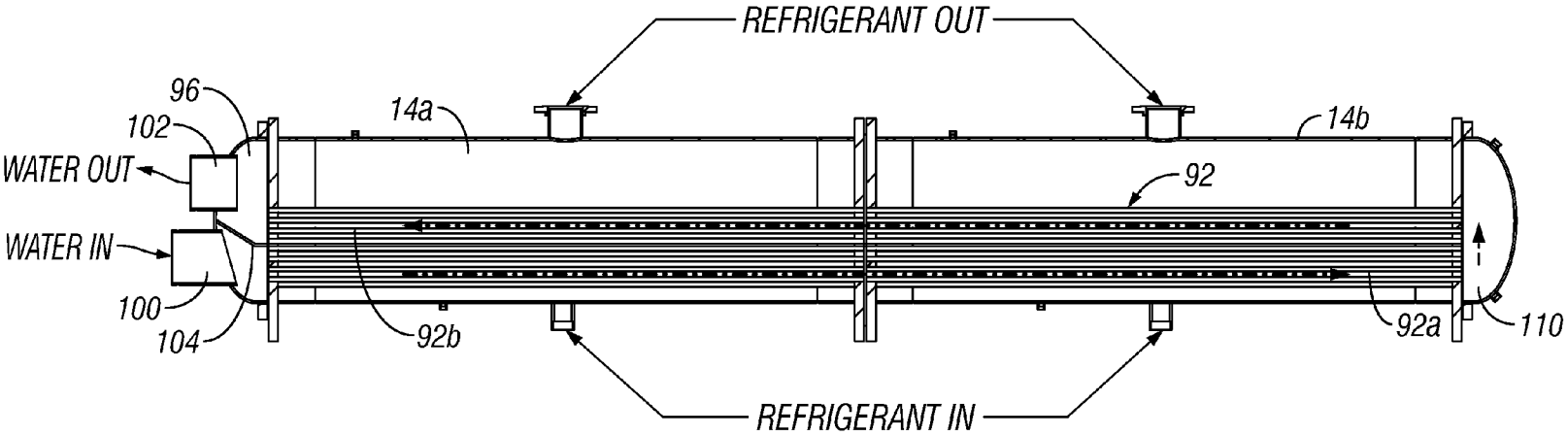
FIG. 9 is a side partly sectional view of two interconnected flooded shell-and-tube liquid heat exchangers illustrating the flow path of the water being heated or cooled.

As seen in FIGS. 1 and 2, each of the ends 32 and 36 of the last or end unit 12*b* in the system 10 is enclosed with a dome-shaped end cap 110 and 112. The end caps 110 and 112 are configured to direct water (liquid) coming out of the inlet tubes 92*a* back into the outlet tubes 92*b*. The flow of the water (liquid) is depicted in FIG. 9, which illustrates the flow path created by the connecting heat 96, the interconnected evaporators 14*a* and 14*b*, and the end cap 110. Water enters the inlet 100 in the connection head 96 and is diverted by the diving plate 104 into the lower inlet tubes 92*a*. Water exiting the inlet tubes 92*a* is redirected by the dome-shaped end cap 110 back into the upper return or outlet tubes 92*b*. Then, water leaving the outlet tubes 92*b* is passed out the outlet 102. Thus, the heat exchangers are configured to pass the water or other fluid to be cooled or heated through the tubes 92 and the refrigerant is circulated through the shell around the tubes.

Figure 10:
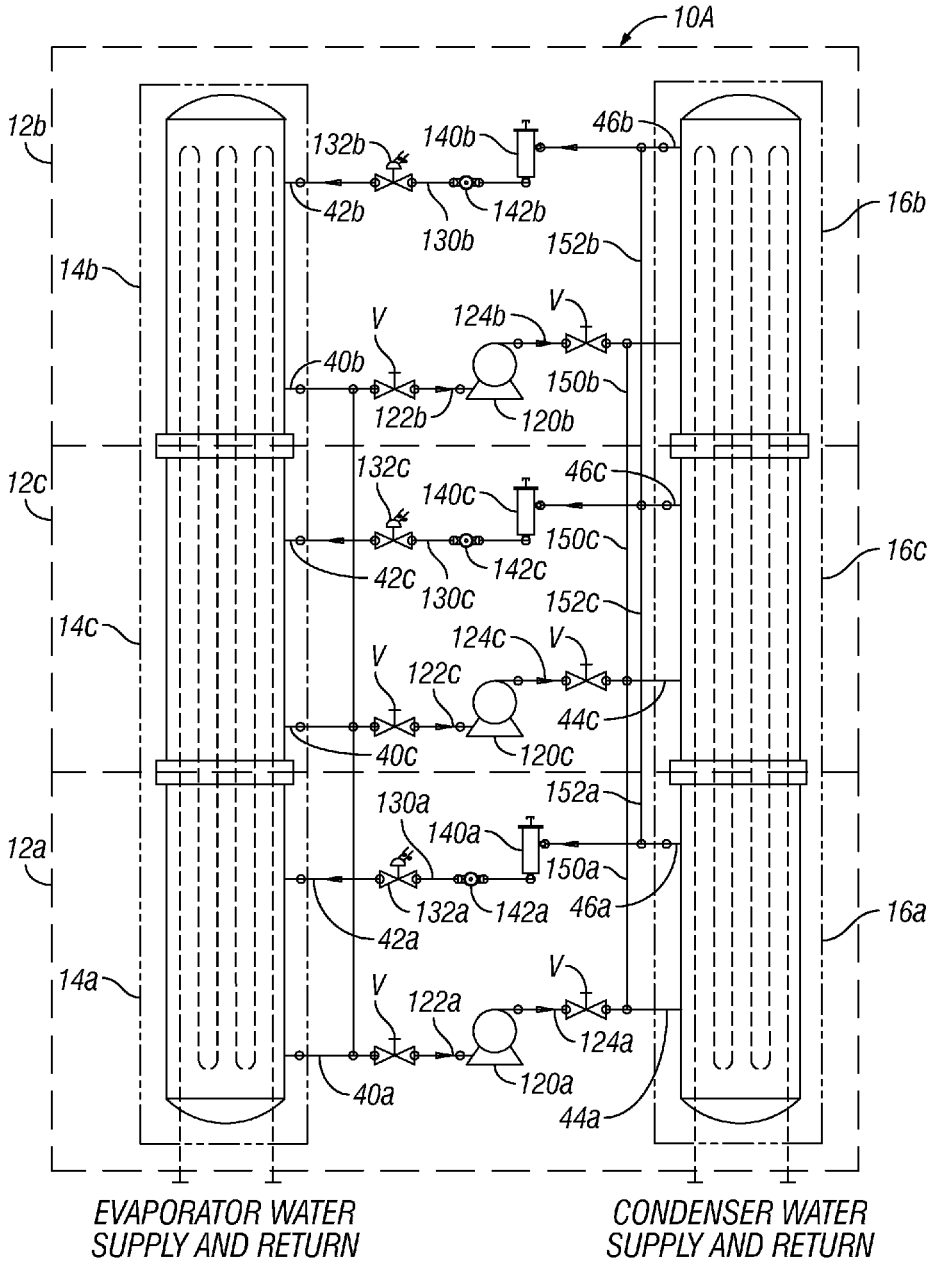
FIG. 10 is a diagrammatic drawing of an illustrative three-unit chiller system depicting the refrigerant circuits and the flow path of water through the heat exchangers.

Turning now to FIG. 10, the components and operation of the preferred refrigerant circuit will be explained. The system 10A depicted in FIG. 10 includes three modular chiller units, including a first unit 12*a*, as second end unit 12*b*, and a third interposed unit 12*c*. The units 12*a* and 12*b* of this embodiment are the same as described above in reference to the system 10 of FIGS. 1-9. The middle unit 12*c* is similar to the units 12*a* and 12*b*, except that it includes no end cap or connecting head.

The refrigerant circuit of unit 12*a* includes a compressor 120*a* connected to the refrigerant outlet 40*a* of the evaporator 14*a* by the suction line 122*a*. The discharge line 124*a* connects the outlet of the compressor 120*a* to the refrigerant inlet 44*a* of the condenser 16*a*. Isolation valves, all designated as "V," may be included on both sides of the compressor 120*a*.

The liquid line 130*a* extends from the refrigerant outlet 46*a* of the condenser 16*a* to the refrigerant inlet 42*a* of the evaporator 14*a*. A thermal expansion valve 132*a* is interposed in the liquid line 130*a*. The liquid line 130*a* may include a filter drier 140*a* or a sight glass moisture indicator 142*a* or both.

Each unit 12*a*, 12*b*, and 12*c* includes a suction equalization line extending from the suction line of the refrigerant circuit and connectable to the suction line of the refrigerant circuit in an adjacent like modular chiller unit. Thus, the suction equalization line 50*a* connects the suction line 122*a* of unit 12*a* with the suction lines 122*b* and 122*c* of unit 12*b* and unit 12*c*.

Each unit 12*a*, 12*b*, and 12*c* includes a discharge equalization line extending from the discharge line of the refrigerant circuit and connectable to the discharge line of the refrigerant circuit in an adjacent like modular chiller unit. Thus, the discharge equalization lines 150*a*, 150*b*, and 150*c* connects the discharge line 124*a* of unit 12*a* with the discharge lines 124*b* and 124*c* of unit 12*b* and unit 12*c*.

Each unit 12*a*, 12*b*, and 12*c* includes a liquid equalization line extending from the liquid line of the refrigerant circuit and connectable to the liquid line of the refrigerant circuit in an adjacent like modular chiller unit. Thus, the liquid equalization lines 152*a*, 152*b*, and 152*c* connects the liquid line 120*a* of unit 12*a* with the liquid lines 130*b* and 130*c* of unit 12*b* and unit 12*c*.

Now it can be seen that when two or more modular chiller units are interconnected to form a chiller bank, the interconnected heat exchangers do double duty as heat exchangers and headers for a common water circuit. Similarly, the interconnecting equalization lines in the refrigerant circuits serve as headers or manifolds creating parallel flow of the refrigerant through all the refrigerant circuits, even if less than all the compressors are operating. This large heat transfer area is available to even a single operating compressor, providing highly efficient partial load operation.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A modular chiller unit for use with like modular chiller units in a bank of modular chiller units, the chiller unit comprising:

a flooded shell-and-tube liquid evaporator comprising:

first and second ends, wherein each of the first and second ends is connectable to the evaporator of an adjacent like modular chiller unit, so that when the modular chiller unit is connected in a bank of like modular chiller units, interconnected evaporators function as one continuous evaporator for the bank of chiller units; and a refrigerant inlet and a refrigerant outlet;

a flooded shell-and-tube liquid condenser having first and second ends;

first and second ends, wherein each of the first and second ends is connectable to a condenser in an adjacent like modular chiller unit, so that when the modular chiller unit is connected in a bank of like modular chiller units, interconnected condensers function as one continuous condenser for the bank of chiller units; and a refrigerant inlet and a refrigerant outlet;

a refrigerant circuit comprising:

a compressor;

a thermal expansion valve;

a suction line connecting the refrigerant outlet of the evaporator with the compressor;

a discharge line connecting the compressor to the refrigerant inlet of the condenser; and a liquid line connecting the refrigerant outlet of the condenser to the expansion valve and the expansion valve to the refrigerant inlet of the evaporator; and a suction equalization line extending from the suction line of the refrigerant circuit and connectable to the suction line of the refrigerant circuit in an adjacent like modular chiller unit;

a discharge equalization line extending from the discharge line of the refrigerant circuit and connectable to the discharge line of the refrigerant circuit in an adjacent like modular chiller unit;

a liquid equalization line extending from the liquid line of the refrigerant circuit and connectable to the liquid line of the refrigerant circuit in an adjacent like modular chiller unit;

whereby, when the modular chiller unit is connected in a bank of like modular chiller units, the interconnected suction, discharge, and equalization lines allow the compressor in an operating unit to circulate refrigerant in parallel through the evaporators and condensers of other non-operating chiller units in the bank of chiller units.

2. The modular chiller unit of claim 1 further comprising a connecting flange on each of the first and second ends of each of the evaporator and the condenser.

3. The modular chiller unit of claim 2 wherein the evaporator and the condenser are stacked one on top of the other and wherein each of the connecting flanges includes an abutment edge shaped to stabilize the stacked evaporator and condenser.

4. The modular chiller unit of claim 3 wherein the evaporator is stacked on top of the condenser and wherein each of the connecting flanges is square.

5. The modular chiller unit of claim 1 wherein each of the evaporator and condenser includes a plurality of inlet tubes and a plurality of outlet tubes and wherein the chiller unit further comprises an end cap for each of the evaporator and condenser, each such end cap configured to direct fluid from the plurality of inlet tubes to the plurality of outlet tubes.

6. The modular chiller unit of claim 1 wherein each of the evaporator and condenser includes a plurality of inlet tubes and a plurality of outlet tubes and wherein the chiller unit further comprises a water connecting head for each of the evaporator and condenser, each such water connecting head comprising a water inlet continuous with the plurality of inlet tubes and a water outlet continuous with the plurality of outlet tubes, and a dividing plate for separating the inlet and outlet flow.

7. The modular chiller unit of claim 1 further comprising an isolation valve in the suction line.

8. The modular chiller unit of claim 7 further comprising an isolation valve in the discharge line.

9. The modular chiller unit of claim 1 further comprising an isolation valve in the discharge line.

10. The modular chiller unit of claim 1 further comprising a filter drier in the liquid line.

11. The modular chiller unit of claim 1 further comprising a sight glass moisture indicator in the liquid line.

12. A bank of chillers comprising a plurality of modular chiller units as defined in claim 1.

13. The bank of chillers of claim 12 wherein the plurality of modular chillers includes a least a first modular chiller unit and a last modular chiller unit, wherein each of the evaporator and condenser in the first and last modular chiller units includes a plurality of inlet tubes and a plurality of outlet tubes, and wherein the first modular chiller unit further comprises a water connecting head for each of the evaporator and condenser, each such water connecting head comprising a water inlet continuous with the plurality of inlet tubes and a water outlet continuous with the plurality of outlet tubes, and a dividing plate for separating the inlet and outlet flow.

14. The bank of chillers of claim 13 wherein the last modular chiller unit further comprises an end cap for each of the evaporator and condenser, each such end cap configured to direct fluid from the plurality of inlet tubes to the plurality of outlet tubes.

15. The bank of chillers of claim 14 wherein the plurality of modular chillers includes at least one interposed modular chiller unit.

16. The bank of chillers of claim 15 wherein the plurality of modular chillers includes two interposed modular chiller units including a second chiller unit and a third chiller unit.

* * * * *

UNITED STATES PATENT AND TRADEMARK OFFICE

CERTIFICATE OF CORRECTION

PATENT NO. : 9,146,045 B2
APPLICATION NO. : 13/960926
DATED : September 29, 2015
INVENTOR(S) : Ross A. Miglio It is certified that error appears in the above-identified patent and that said Letters Patent is hereby corrected as shown below:

In the Specification:
Column 2, line 16: replace “of a two of” with --of two--.
Column 2, line 29: replace “14” with --14a--.
Column 2, line 56: replace “extending” with --extends--.
Column 2, line 57: replace “that suction” with --that the suction--.
Column 2, line 62: replace “line connects” with --line that connects--.
Column 2, line 65: replace “24” with --34--.
Column 3, line 4: replace “72, 72,” with --72, 74,--.
Column 3, line 18: replace “surround” with --surrounding--.
Column 3, line 25: replace “domed” with --dome--.
Column 3, line 25: replace “an upper water outlet inlet” with --a water inlet fitting--.
Column 3, line 26: replace “a lower water” with --a water--.
Column 3, line 37: replace “heat” with --head--.
Column 3, line 39: replace “diving” with --dividing--.
Column 3, line 43: replace “out the” with --out of the--.
Column 3, line 50: replace “as second” with --a second--.
Column 4, line 37: replace “inventions” with --invention--.
Column 4, line 40-41: replace “inventions” with --invention--.

In the Claims:
Column 6, line 27: replace “a least” with --at least--.

Signed and Sealed this
Fifth Day of April, 2016

Michelle K. Lee

Michelle K. Lee
*Director of the United States Patent and Trademark Office*